US010549951B2

(12) United States Patent
Studer et al.

(10) Patent No.: US 10,549,951 B2
(45) Date of Patent: Feb. 4, 2020

(54) UNLOCKING DEVICE, ELEVATOR SYSTEM HAVING AN UNLOCKING DEVICE, AND METHOD FOR ACTUATING AN UNLOCKING DEVICE

(71) Applicant: Inventio AG, Hergiswil (CH)

(72) Inventors: Christian Studer, Kriens (CH); Raphael Bitzi, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 295 days.

(21) Appl. No.: 15/533,729

(22) PCT Filed: Dec. 7, 2015

(86) PCT No.: PCT/EP2015/078769
§ 371 (c)(1),
(2) Date: Jun. 7, 2017

(87) PCT Pub. No.: WO2016/091777
PCT Pub. Date: Jun. 16, 2016

(65) Prior Publication Data

US 2017/0320704 A1 Nov. 9, 2017

(30) Foreign Application Priority Data

Dec. 11, 2014 (EP) ..... 14197474

(51) Int. Cl.
*B66B 5/00* (2006.01)
*B66B 9/00* (2006.01)
(Continued)

(52) U.S. Cl.
CPC ..... *B66B 5/0087* (2013.01); *B66B 9/00* (2013.01); *B66B 11/0246* (2013.01);
(Continued)

(58) Field of Classification Search
CPC ..... B66B 5/0087; B66B 5/0043; B66B 9/00; B66B 11/0246; B66B 13/22; B66B 13/24; E05B 47/0002; E05B 65/006
See application file for complete search history.

(56) References Cited

U.S. PATENT DOCUMENTS 5,727,657 A * 3/1998 Foelix ..... B66B 5/005 187/356
6,138,798 A * 10/2000 Macuga ..... B66B 5/005 187/294
(Continued)

FOREIGN PATENT DOCUMENTS

GB 1498039 A 1/1978
WO 2011076531 A1 6/2011

*Primary Examiner* — Michael A Riegelman
(74) *Attorney, Agent, or Firm* — William J. Clemens; Shumaker, Loop & Kendrick, LLP

(57) ABSTRACT

An unlocking device with an actuator releases a safety cover of a maintenance opening for opening. The locking device has a safety circuit for actuating the actuator. The safety circuit includes at least one first switching contact and a second switching contact arranged in series, wherein the actuator in a closed state of the first and the second switching contacts is connected by the safety circuit with a power source, and the first switching contact can be switched by a control unit. One or more of the unlocking device can be used in an elevator system.

16 Claims, 3 Drawing Sheets

(51) Int. Cl.

| | |
|---|---|
| ***B66B 11/02*** | (2006.01) |
| ***B66B 13/22*** | (2006.01) |
| ***E05B 47/00*** | (2006.01) |
| ***E05B 65/00*** | (2006.01) |

(52) U.S. Cl.
CPC ..... *B66B 13/22* (2013.01); *E05B 47/0002* (2013.01); *E05B 65/006* (2013.01); *E05B 2047/0048* (2013.01)

(56) References Cited

U.S. PATENT DOCUMENTS

| | | | | |
|---|---|---|---|---|
| 6,223,861 | B1 * | 5/2001 | Sansevero | B66B 13/22 187/316 |
| 2004/0173415 | A1 * | 9/2004 | Kocher | B66B 5/005 187/316 |
| 2017/0320704 | A1 * | 11/2017 | Studer | B66B 5/0043 |

* cited by examiner

UNLOCKING DEVICE, ELEVATOR SYSTEM HAVING AN UNLOCKING DEVICE, AND METHOD FOR ACTUATING AN UNLOCKING DEVICE

FIELD

The invention relates to an unlocking device, by means of which a safety cover can be released for purposes of opening a maintenance opening. In particular the invention relates to an elevator system with the said unlocking device, together with a method for the actuation of the unlocking device.

BACKGROUND

An elevator system has a plurality of components, such as, for example, a drive, guide rails, car guide shoes, braking systems, or similar, which must be maintained at regular intervals in order to ensure trouble-free and reliable operation. Many of these components are arranged in a shaft of the elevator system. For the maintenance tasks a maintenance engineer must be able to obtain appropriate access to the interior of the shaft. As a general rule, this takes place by way of a maintenance opening that is covered by a safety cover, such as, for example, a safety door or a panel. Since an elevator car travels in the shaft interior, special safety measures are necessary when accessing the shaft interior.

US 2004/173415 A1 describes a controllable cover for a floor door lock of a shaft door of an elevator system. In normal operation of the elevator system the cover prevents access to the floor door lock. Access is allowed if a so-called car column, or a so-called counterweight column, is set in position, and as a result the elevator car or the counterweight is unable to travel down to the floor of the shaft. In addition, in the event of a fire or another emergency, access to the floor door lock is allowed independently of the position of the car and counterweight columns. Thus only one condition must be fulfilled in order to allow access.

A locking mechanism for a shaft door of an elevator system is described in GB 1 498 039 A. The locking mechanism is deactivated if two switches arranged in series are closed. The first switch can be closed by a fitter by means of a button. The second switch is closed if an elevator car is located at a defined position. Further conditions do not need to be fulfilled in order for the locking mechanism to be deactivated.

The patent document WO 2011/076531 A1 describes a shaft access system, which is intended to ensure safe access to the shaft. The shaft access system comprises a control unit, which controls the access to the shaft, in particular by way of a shaft door. Here the shaft access system can be operated in various modes, in particular in a normal operation mode and in a maintenance mode. The mode can only be changed by an authorized person such as a maintenance engineer, by inputting a code to the control unit. With a change of operating mode one or a plurality of shaft doors are released for opening.

One disadvantage of this solution is that a change of mode can take place as a result of a software error in the control unit, or as a result of an unauthorized manipulation of the control unit. In the event of such an unauthorized change of mode the shaft doors are nevertheless released for opening. Accordingly, unauthorized persons can gain access to the shaft.

Moreover, the shaft door released for opening cannot always be arranged in the immediate vicinity of the control unit. Should for example, access to the shaft pit be enabled by way of the lowermost shaft door, and if the control unit is arranged in the region of the elevator control system in the uppermost floor of the building, then the lowermost shaft door released for opening is unsupervised for the time taken to move between the control unit and this lowermost floor door. For this time, therefore, an unauthorized person could obtain access to the shaft by way of this floor door.

For unauthorized persons without any special knowledge of the mode of operation of an elevator system, time spent in the shaft can lead to serious injury.

SUMMARY

It is therefore an object of the invention to improve further the safety of an elevator system, in particular to ensure that access to the shaft interior by way of a maintenance opening is secure.

This object is achieved by means of an unlocking device with an actuator, by means of which a safety cover of a maintenance opening can be released for opening. Moreover, the locking device is fitted with a safety circuit, by way of which the actuator can be actuated. The safety circuit comprises at least a first switching contact and a second switching contact, wherein in the closed state of the first and second switching contacts the actuator can be connected via the safety circuit with a power source. Moreover the first and second switching contacts are arranged in series in the safety circuit. A further aspect of the invention relates to an elevator device with the said unlocking device and a method for operating the unlocking device. In accordance with the invention the first switching contact can be switched by means of a control unit.

Here it is of advantage that the unlocking device is fitted with two switching contacts, which must be actuated in a coordinated manner in order to release a safety cover for opening, or more particularly, for obtaining access to the shaft interior. Thus by the actuation of both switching contacts any accidental release of the safety cover for opening can essentially be avoided. By this means operational safety can be increased. By virtue of the arrangement in series of the first and second switching contacts a simple and reliable arrangement for the activation of the actuator is achieved. It is advantageous to switch the switching contact by means of a programmable computer, that is to say, by means of the control unit. This is because the control unit can, for example, set an authorization enquiry before switching the first switching contact, which authorization enquiry can only be answered by a trained person, such as, for example, a maintenance engineer. The authorization enquiry can require, amongst other items, the input of a code. By this means the probability of an unauthorized release for purposes of opening the safety cover can be further reduced. Moreover, the control unit can interrogate or check further conditions, which must be fulfilled for the release of the safety cover for opening. For example, a check can be made as to whether the elevator car is located in a prescribed position or in a prescribed region within the elevator shaft, whether the shaft lighting system is switched on, whether the elevator car is stationary, and/or whether persons or material are located in the elevator car.

Here the term "maintenance opening" is understood to mean an opening that provides access to a component that is to be maintained. In the context of elevator systems this relates primarily to components that are arranged in a shaft, such as, for example, a drive, guide rails, car guide shoes, pulleys, car or counterweight buffers, positioning systems, speed monitoring systems, and similar. The shaft is therefore made accessible via a maintenance opening located on the building or on the car. Shaft door openings, car door openings, car roof or floor hatches, maintenance windows and similar are to be seen as maintenance openings.

A safety cover is intended to prevent access to the shaft to an unauthorized person. Depending upon the maintenance opening a safety cover can be designed in a variety of ways and comprises both doors, which, for example, cover a shaft door opening or a car door opening, or also simple panels with which a maintenance window or a hatch is covered.

In the event that a plurality of second switching contacts is present, each second switching contact is arranged in series with the first switching contact. The plurality of second switching contacts can be arranged in parallel and/or in series with one another.

Here the control unit is understood to be a unit that has at least one microprocessor, one working memory and one read-only memory. Such a control unit is therefore designed for purposes of executing computer-based programs, and for purposes of activating, or more particularly, switching, the first switching contact. The control unit can, for example, be designed as an elevator controller, which, in addition to the basic tasks intended for an elevator controller, such as the registration of car calls, or the assignment and execution of journeys of the elevator car, also switches the first switching contact. Alternatively, the control unit can also be configured as a safety control unit, which monitors the safety-relevant states of the elevator system and, when an unsafe condition occurs, brings the elevator system back into a safe state. This includes, for example, the monitoring of the states of the shaft doors, wherein the elevator system is shut down if a shaft door is open and if no elevator car is located on the floor associated with the shaft door. In a further alternative embodiment, the control unit can also be provided just for the purpose of switching the first switching contact. In this configuration, the control unit is allocated in a dedicated manner to the safety circuit.

The first switching contact can preferably be switched as a function of an operating mode of an elevator system. In particular, the first switching contact can be switched into a closed state in the event of a changeover from a normal operating mode to a maintenance mode of the elevator system by means of the control unit.

Here it is ensured that the first switching contact can only be switched during an operating mode intended for a specific task. Thus, the switching contact for the release of a maintenance opening can only be switched if the elevator system is in a maintenance mode. In this maintenance mode, the range of movement of the elevator car can be reduced in order to ensure safe access to the shaft for a maintenance engineer. In this manner safety precautions are taken before the release of the safety cover for opening; these permit safe working in a potentially dangerous zone of the elevator system.

The second switching contact can preferably be switched by a manual manipulation.

"Manual manipulation" is understood to mean the manual operation of an actuation device, for example an actuation button, which is operatively connected to the second switching contact, and by way of which the second switching contact can be switched. Thus the switching contact can be made as a result of a pushing or pressing movement of the maintenance engineer's hand. Optionally the actuation device can also be implemented as an electromechanical actuation mechanism, which is actuated manually by way of a button, a touch-sensitive screen, or similar.

By the interaction of the computer-based automatic switching of the first switching contact and the additional manual switching of the second switching contact, any faulty switching occurring automatically as a result of a faulty operating control unit can be excluded. The actuator of the unlocking device can therefore only be activated by the confirmatory manual manipulation, and the safety cover can accordingly be released for opening.

The second switching contact is preferably arranged in an actuation region to allow the safety cover to be opened.

Here it is advantageous that the second switching contact is arranged in such a way that the maintenance engineer is already located in an actuation region for purposes of opening the safety cover when the second switching contact is switched. This ensures that the safety cover is opened only in the presence of the maintenance engineer, and thus the likelihood of any faulty manipulation by an unauthorized person is reduced.

The "actuation region" is understood to mean a region in the vicinity of the safety cover, in particular a region that is sufficiently close to the safety cover such that a maintenance engineer who is located in this region, after the release of the safety cover for opening, can immediately open, or at least is able to open, the safety cover.

Optionally the second switching contact can comprise a first second switching contact and a second second switching contact. Here both second switching contacts can be switched by a manual manipulation. It is particularly advantageous if in the case of this optional embodiment of the second switching contact both second switching contacts are arranged in the actuation region. In particular, both second switching contacts can be arranged such that for the release of the safety cover for opening both hands of the maintenance technician are in a predefined position. Moreover the safety circuit can be configured such that a release of the safety cover for opening only takes place if both second switching contacts are manually switched at the same time. This ensures that both hands of the maintenance engineer are actually located at the predefined positions.

The actuator is preferably designed as a permanent electromagnetic clamp. Here the permanent electromagnetic clamp is arranged with reference to the safety cover such that in an inactive state the clamp holds the safety cover in a position covering the maintenance opening, and in an active state releases the safety cover for opening.

Here, for example, the permanent electromagnet is mounted securely on the elevator car and exerts a magnetic attractive force onto the safety cover, which is opposed to any movement for purposes of opening the safety cover. Here the magnetic attractive force is dimensioned such that the safety cover is reliably held by the permanent electromagnet in the position covering the maintenance opening.

The actuator is alternatively designed as an electromagnetic latch. The electromagnetic latch comprises a lever arm, preferably with a hook, which is designed so as to engage with a holding device, together with an electromagnet that can be activated for purposes of actuating the lever arm. The holding device can, for example, be designed as a projecting bracket, a stop, a recess, or similar. Here the permanent electromagnetic latch is arranged with reference to the safety cover such that in an inactive state, in which the electromagnet is disconnected from the power source, the latch holds the safety cover in a position covering the maintenance opening, and in an active state, in which the electromagnet is connected with the power source, releases the safety cover for opening. The electromagnetic latch is, for example, securely mounted on the elevator car and by means of the lever arm engages with a holding device arranged on the safety cover. As a result of the engagement of the latch with the holding device a mechanical operative connection is created that operates against any movement for purposes of opening the safety cover.

One aspect of the invention relates to an elevator system with an elevator car, which can travel in an elevator shaft. In addition, the elevator system comprises an unlocking device as described above, a safety cover for purposes of covering a maintenance opening, a power source for purposes of activating an actuator of the unlocking device, a control unit for purposes of switching a first switching contact of the unlocking device, and an actuation device that can be actuated manually for purposes of switching a second switching contact of the unlocking device.

The maintenance opening is preferably designed as a car roof hatch, a car floor hatch, a car maintenance window, a car boarding opening, or a shaft boarding opening. For this purpose the safety cover is accordingly designed as a door, a panel, or similar.

A further aspect of the invention relates to a method for purposes of actuating the above described unlocking device. The method here comprises the following steps:

closure of the first switching contact and closure of the second closing contact, wherein the actuator is activated and the safety cover is released by the actuator for opening.

The first switching contact is preferably closed by means of the control unit. Furthermore, the first switching contact is closed by means of the control unit as a function of an operating mode of the elevator system, in particular in the event of a changeover from a normal operating mode to a maintenance mode. Finally the second switching contact can be closed by a manual manipulation.

DESCRIPTION OF THE DRAWINGS

With the aid of examples of embodiment and figures the invention is further illustrated in what follows. Here.

DETAILED DESCRIPTION

Figure 1:
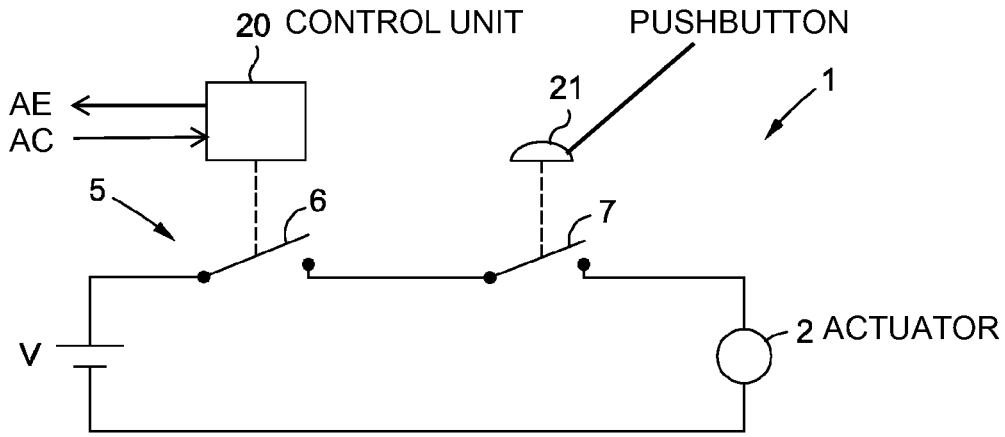
FIG. 1 shows an inventive unlocking device with an actuator in a schematic circuit diagram.

FIG. 1 shows a first example of embodiment of the inventive unlocking device 1 in a schematic circuit diagram. The unlocking device 1 comprises a safety circuit 5 with at least two switching contacts 6, 7 and one actuator 2. In the example shown the two switching contacts 6, 7 are connected with one another in series. The two switching contacts 6, 7 can assume an open or a closed state. The actuator 2 can be connected by way of the safety circuit 5 with a power source V, wherein the actuator 2 is only supplied with power if both switching contacts 6, 7 are closed.

The first switching contact 6 can be switched by means of a control unit 20. The control unit 20 is designed to switch the first switching contact 6 as a result of a change of an operating mode. In particular in the course of a normal operating mode the first switching contact 6 is in an open state. In the event of a changeover from the normal operating mode to a maintenance mode the first switching contact 6 assumes a closed state as a result of a control instruction from the control unit 20.

The second switching contact 7 can be switched manually. To this end the second switching contact 7 is for example connected with a pushbutton 21. In an initial position the second switching contact 7 is in an open state. By a manual actuation of the pushbutton 21 the second switching contact 7 can be brought into its closed state.

Figure 2:
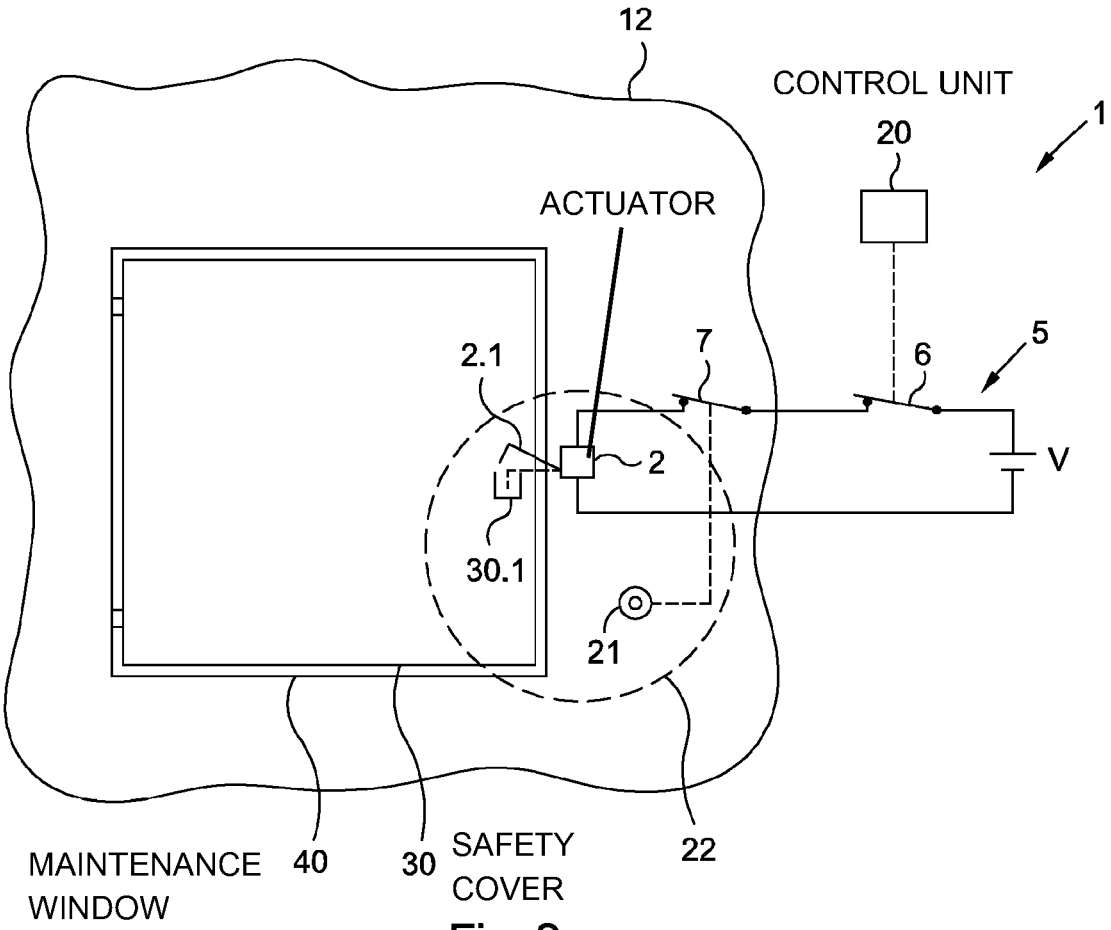
FIG. 2 shows an exemplary arrangement of an inventive unlocking device for purposes of releasing a safety cover of a maintenance window for opening, in a highly schematic illustration.

FIG. 2 shows an example of embodiment of the unlocking device 1 for a release of a safety cover 30 of a maintenance window 40 for opening. Here the maintenance window 40 is arranged in a sidewall of an elevator car 12. With the safety cover 30 open, the maintenance window 40 provides access to elevator components that are arranged in a shaft, and can be reached from the interior of the elevator car 12 for maintenance tasks.

With both switching contacts 6, 7 in the closed state the safety circuit 5 of the unlocking device 1 connects the actuator 2 with a power source V. The actuation of the first switching contact 6 takes place by way of the control unit 20 in the event of a changeover from a normal operating mode of an elevator system to a maintenance mode of the elevator system. The actuation of the second switching contact 7 takes place by way of the actuation button 21. Here the actuation button 21 is arranged in an actuation region 22 for purposes of opening the safety cover 30.

Here the actuator 2 is designed as an electromagnetic latch and is fitted with at least one lever arm 2.1, which in an engagement position engages with a holding device 30.1, and at least one electromagnet. The holding device 30.1 is securely connected with the safety cover 30 and the actuator 2 is preferably mounted in a region of the elevator car 12 in a region that is not visible to an occupant of the car, for example behind the internal lining of the elevator car 12. The lever arm 2.1 can be brought from the engagement position (illustrated as a dashed line) into a release position.

If the maintenance engineer wishes to undertake maintenance tasks through the maintenance window 40, in a first step he brings the elevator system 10 into a maintenance mode. To this end he inputs, for example, a code at an input interface to the control unit 20. The code can be typed in by way of keys of the input interface or similar. In a particularly simple embodiment the input interface comprises just a single key, with which, the elevator system 10 can be brought into a maintenance mode with a single touch. By virtue of the change of mode the first switching contact 6 is closed.

After the maintenance engineer has entered into the actuation region 22 of the elevator car 12, in a second step he actuates the actuation button 21 in order to close the second switching contact 7 also. FIG. 2 shows a state in which both switching contacts 6, 7 are closed. Here the actuator 2 is supplied with power from the power source V. As a consequence the electromagnet of the actuator 2 is activated, which pivots the lever arm 2.1, as shown in FIG. 2, from the engagement position into the release position, and releases the safety cover 30 for opening.

Finally the maintenance engineer can pivot the safety cover 30 upwards, which is now released for opening, and can thus gain access through the open maintenance window 40 to the shaft, or more particularly to the elevator components that must be maintained.

Figure 3:
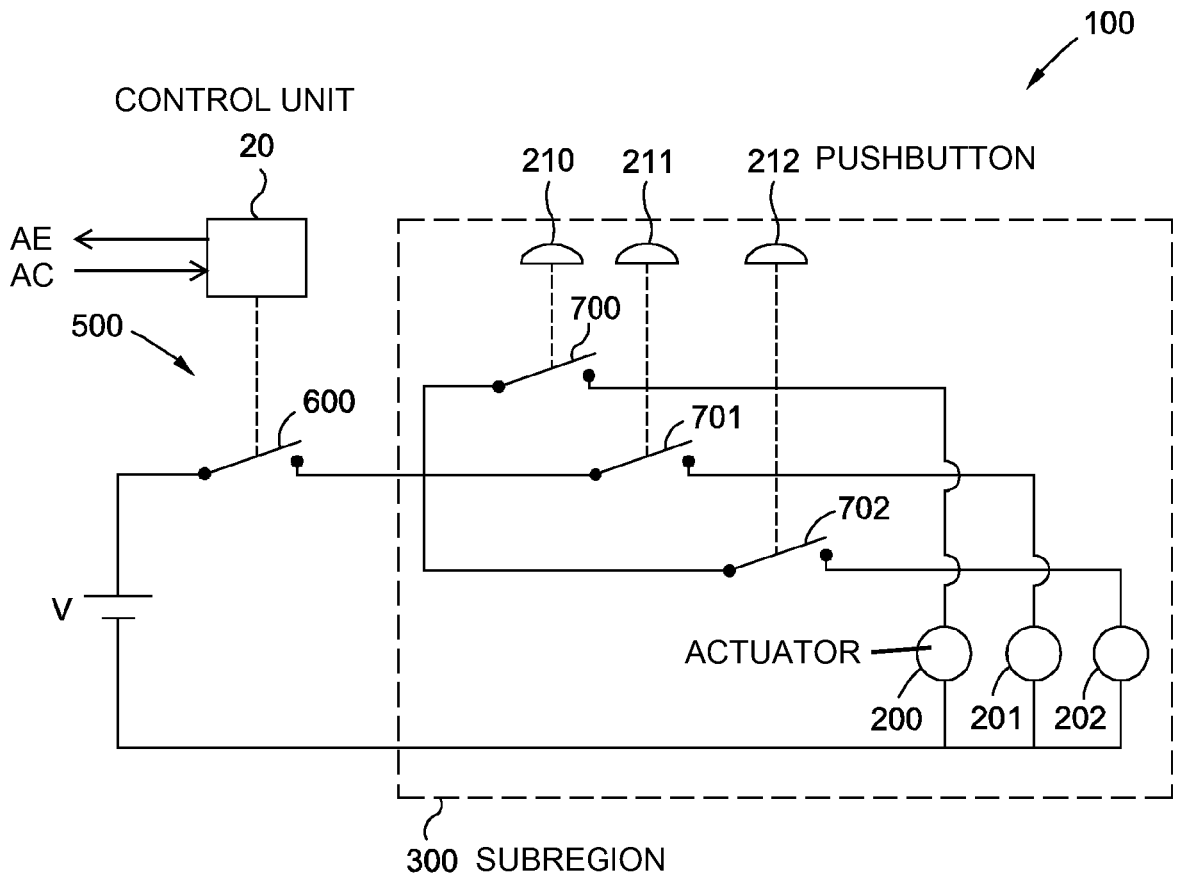
FIG. 3 shows an inventive unlocking device with a plurality of actuators in a schematic circuit diagram.

FIG. 3 shows a second example of embodiment of the unlocking device 100 for a plurality of maintenance openings. Accordingly the unlocking device 100 in this second example of embodiment is fitted with a plurality of actuators 200, 201, 202 and a plurality of associated switching contacts 700, 701, 702 that can be manually actuated. For an actuation a plurality of associated actuation buttons 210, 211, 212 is proposed here. In the example shown, three actuators 200, 201, 202 are shown, together with associated switching contacts 700, 701, 702 and actuation buttons 210, 211, 212. Needless to say, the person skilled in the art can also implement a different number of actuators 200, 201, 202, depending on how many maintenance openings are provided in the elevator system.

The design and functionality of the unlocking device 100 in accordance with FIG. 3 is in many respects the same as that of the unlocking device 1 in FIG. 1. Consequently, the unlocking device 100 of the second example of embodiment is described in terms of a comparison with the unlocking device 1 of the first example of embodiment.

The unlocking device 100 comprises a safety circuit 500 with a first switching contact 600 and a plurality of second switching contacts 700, 701, 702. Here too the first switching contact 600 can be switched by means of a control unit 20. The mode of operation and activation of the first switching contact 600 corresponds to that of the switching contact 6 in FIG. 1.

The actuators 200, 201, 202 and actuation buttons 210, 211, 212 assigned to the second switching contacts 700, 701, 702 can be implemented from components such as the second switching contact 7, the actuator 2, and the actuation button 21, which are identical in construction to those in FIG. 1. The functionality of these components also corresponds to that of the corresponding components in FIG. 1. The individual second switching contacts 700, 701, 702 are arranged in parallel with one another in the safety circuit 500, as are the individual actuators 200, 201, 202. With regard to the first switching contact 600, on the other hand, the second switching contacts 700-702 and actuators 200-202 allocated to the latter are arranged in series. An actuator 201 is thus activated with a closed state of the first switching contact 600 and of the associated second switching contact 701, wherein the actuator 201 is connected to the power source V. As a consequence of this activation, an associated safety cover is released for opening.

Figure 4:
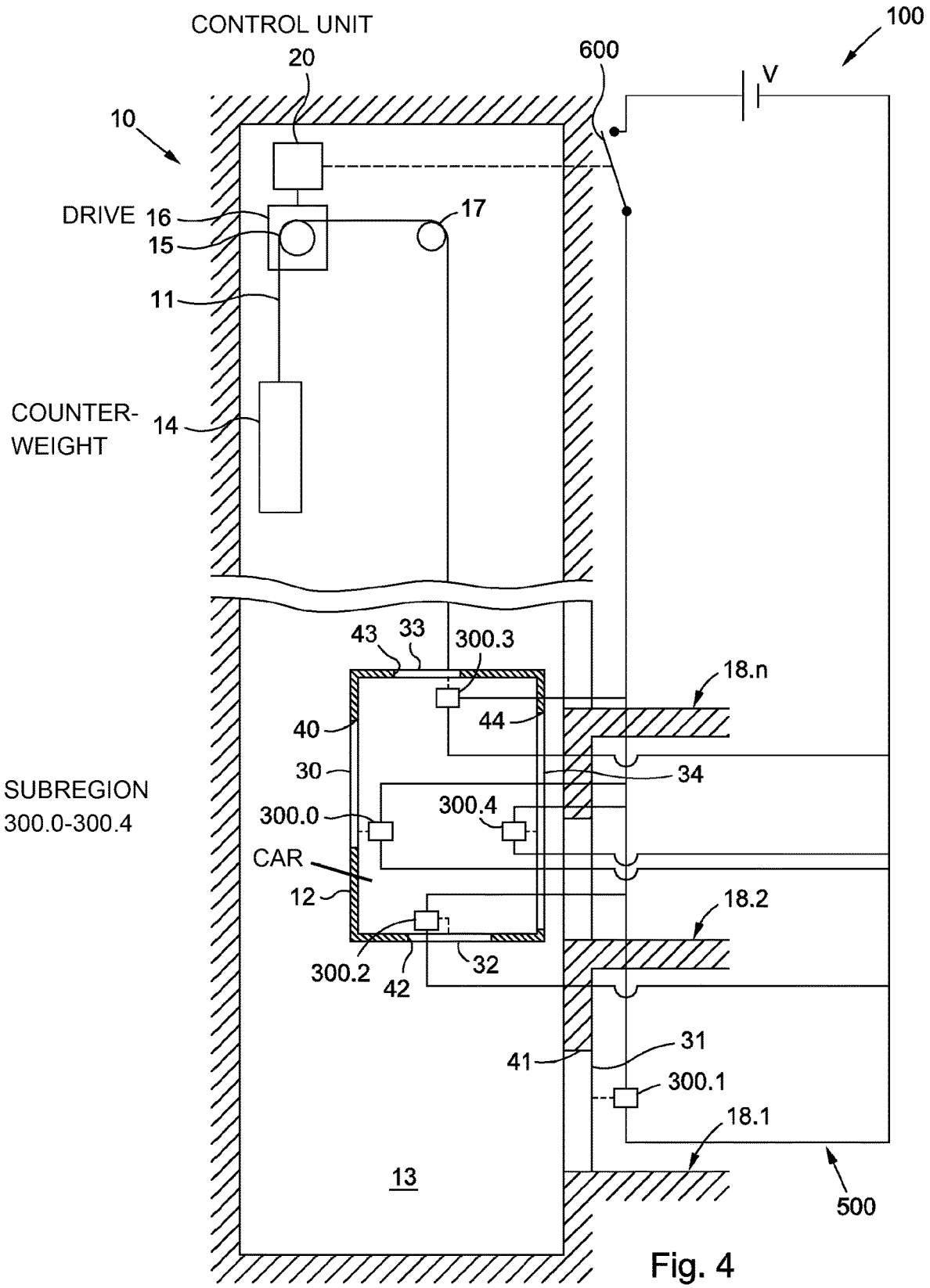
FIG. 4 shows an elevator system with an inventive unlocking device for purposes of releasing a plurality of safety covers of associated maintenance openings for opening, in a highly schematic illustration.

FIG. 4 shows an elevator system 10 with an unlocking device 100 of the second example of embodiment. The elevator system 10 comprises an elevator car 12 that is suspended from a first end of a means of support 11 with a suspension ratio of 1:1. The means of support 11 runs over a pulley 17 and a sheave 15. A counterweight 14 is suspended from a second end of the means of support 11; this counterbalances the gravitational force of the elevator car 12. The sheave 15 is driven by a drive 16, and transmits a torque of the drive 16 onto the means of support 11, wherein the elevator car 12 can travel in a vertical direction in a shaft 13, and serves a plurality of floors 18.1, 18.2, 18.n.

The unlocking device 100 comprises a power source V, a first switching contact 600, which is switched by a control unit 20, and a plurality of subregions 300.0 to 300.4 of the unlocking device 100, which correspond in their totality to the subregion 300 in FIG. 3. In a deviation from FIG. 3, in which three actuators are provided, the unlocking device 100 in FIG. 4 comprises five actuators for the release for opening of an associated safety cover 30 to 34.

In this exemplary embodiment, the control unit 20 is designed as an elevator controller that at least controls the drive 16, and switches the first switching contact 600 from an open state to a closed state as a result of a changeover in the operating mode, for example from a normal operating mode to a maintenance mode. The control unit 20 can also be designed as a safety control unit, which monitors an elevator system, or it can be designed as a control unit dedicated to the unlocking device 100.

In this example, the elevator system 10 shows five maintenance openings, namely a shaft access opening 41 on the lowest floor 18.1, a car access opening 44, a maintenance window 40, a car roof hatch 43 and a car floor hatch 42. These maintenance openings are covered by corresponding safety covers 30 to 34. A subregion 300.0 to 300.4 of the unlocking device 100 is arranged in the actuation region of each of these safety covers. Each of these subregions comprises an actuator for releasing the respective safety cover 30 to 34 for opening, a second switching contact, together with an actuation button for switching the respective second switching contact, in particular to bring the switching contact into a closed state.

If, for example, a maintenance engineer wants to maintain components of the elevator system 10 that are arranged in the lower region of the shaft 13, he sets the elevator system 10 into a maintenance mode in an analogous manner to the first example of embodiment by means of an input to the control unit 20. By virtue of the change of mode the first switching contact 6 is brought into a closed state.

After the maintenance engineer has entered into the actuation region of the lowest shaft door 31, he presses the actuation button 21 for the subregion 300.1 and thereby closes the second switching contact for the same subregion 300.1.

As a consequence the actuator of the subregion 300.1 is activated, which releases the safety cover 31 for opening 41, and thereby the shaft door 31. In an analogous manner, the maintenance engineer, after the change of mode, can obtain access to other regions of the shaft 13 by way of the maintenance openings 44, 40, 43, 42.

Depending on the maintenance concept and the configuration of the elevator system 10, more or fewer maintenance openings can be provided than is the case in the second example of embodiment in FIG. 4.

The design of the safety circuits 5, 500 illustrated in FIGS. 1 to 4 is purely schematic in nature and serves merely to illustrate the logical functional principles. In particular, the invention is not intended to be limited to a particular cable connection that can be derived from these figures of the respective actuators 2, 200, 201, 202 or switching contacts 6, 7, 600, 700, 701, 702 to the power source V.

As explained above, the control unit 20 can set an authorization enquiry before switching the first switching contact, which authorization enquiry can only be answered by a trained person, such as, for example, a maintenance engineer. As shown in FIGS. 1 and 3, the control unit 20 sets the authorization enquiry AE. The authorization enquiry AE can require as the answer, amongst other items, the input of a code AC at an input to the control unit 20. By this means the probability of an unauthorized release for purposes of opening the safety cover can be further reduced.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An unlocking device for releasing a safety cover of a maintenance opening, comprising:

an actuator for releasing the safety cover;

a safety circuit for activating the actuator, the safety circuit including a first switching contact arranged in series with a second switching contact, wherein the actuator in a closed state of the first switching contact and the second switching contact is connected by the safety circuit with a power source to activate the actuator; and a control unit for switching the first switching contact to the closed state, the control unit being adapted to set an authorization enquiry before switching the first switching contact.

2. The unlocking device according to claim 1 wherein the first switching contact is switched as a function of an operating mode of an elevator system, wherein in an event of a changeover from a normal operating mode to a maintenance mode of the elevator system the first switching contact is switched into the closed state by the control unit.

3. The unlocking device according to claim 1 wherein the second switching contact is switched by a manual manipulation.

4. The unlocking device according to claim 1 wherein the second switching contact is arranged in an actuation region for opening the safety cover.

5. The unlocking device according to claim 1 where in the actuator is a permanent electromagnetic clamp, wherein the permanent electromagnetic clamp is arranged at the safety cover such that in an inactive state the clamp holds the safety cover in a position covering the maintenance opening, and in an active state the clamp releases the safety cover for opening.

6. The unlocking device according to claim 1 wherein the actuator is an electromagnetic latch, wherein the electromagnetic latch is arranged at the safety cover such that in an inactive state the latch holds the safety cover in a position covering the maintenance opening, and in an active state the latch releases the safety cover for opening.

7. A method for actuation of the unlocking device according to claim 1, comprising the steps of:

switching the first switching contact to the closed state; and switching the second closing contact to the closed state wherein the actuator is activated and the safety cover is released by the actuator for opening.

8. The method according to claim 7 wherein the first switching contact switched to the closed state by the control unit.

9. The method according to claim 8 wherein the first switching contact is switched to the closed state by the control unit as a function of an operating mode of the elevator system in response to a changeover from a normal operating mode to a maintenance mode.

10. The method according to claim 7 the second switching contact is switched to the closed state by a manual manipulation.

11. The unlocking device according to claim 1 wherein the control unit switches the first switching contact to the closed state upon receiving a predetermined answer to the authorization enquiry.

12. An elevator system with an elevator car that travels in an elevator shaft, a safety cover that covers a maintenance opening, and an unlocking device for releasing the safety cover, comprising:

an actuator for releasing the safety cover;

a power source for activating the actuator;

a first switching contact;

a control unit for switching the first switching contact to a closed state, the control unit being adapted to set an authorization enquiry before switching the first switching contact;

a second switching contact connected in series with the first switching contact between the actuator and the power source; and an actuation device for manually switching the second switching contact to a closed state whereby the actuator is activated to release the safety cover when the first switching contact and the second switching contact are both in the closed state.

13. The elevator system according to claim 12 wherein the maintenance opening is one of a car roof hatch, a car floor hatch, a car maintenance window, a car boarding or access opening, and a shaft boarding or access opening.

14. The unlocking device according to claim 12 wherein the control unit switches the first switching contact to the closed state upon receiving a predetermined answer to the authorization enquiry.

15. An unlocking device for releasing a safety cover of a maintenance opening in an elevator system, comprising:

a first actuator for releasing a first safety cover;

a second actuator for releasing a second safety cover a safety circuit for activating each of the first actuator and the second actuator;

the safety circuit including a first switching contact arranged in series with a first second switching contact, wherein the first actuator in a closed state of the first switching contact and the first second switching contact is connected by the safety circuit with a power source to activate the first actuator;

the safety circuit including the first switching contact arranged in series with a second second switching contact, the first second switching contact and the second second switching contact being arranged in parallel, wherein the second actuator in a closed state of the first switching contact and the second second switching contact is connected by the safety circuit with a power source to activate the second actuator; and a control unit for switching the first switching contact to the closed state, the control unit being adapted to set an authorization enquiry before switching the first switching contact.

16. The unlocking device according to claim 15 wherein the control unit switches the first switching contact to the closed state upon receiving a predetermined answer to the authorization enquiry.

* * * * *